US010373563B2

(12) United States Patent
Park et al.

(10) Patent No.: US 10,373,563 B2
(45) Date of Patent: Aug. 6, 2019

(54) ORGANIC LIGHT EMITTING DIODE (OLED) DISPLAY

(71) Applicant: LG Display Co., Ltd., Seoul (KR)

(72) Inventors: Youngju Park, Seoul (KR); Sungwook Yoon, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/279,408

(22) Filed: Sep. 28, 2016

(65) Prior Publication Data

US 2017/0092200 A1 Mar. 30, 2017

(30) Foreign Application Priority Data

Sep. 30, 2015 (KR) ..... 10-2015-0138255

(51) Int. Cl.
*G09G 3/3233* (2016.01)
*G09G 3/3266* (2016.01)

(52) U.S. Cl.
CPC ..... *G09G 3/3266* (2013.01); *G09G 3/3233* (2013.01); *G09G 2300/0426* (2013.01); *G09G 2300/0819* (2013.01); *G09G 2300/0842* (2013.01); *G09G 2300/0861* (2013.01); *G09G 2310/0205* (2013.01); *G09G 2310/0262* (2013.01); *G09G 2310/0281* (2013.01); *G09G 2310/0286* (2013.01); *G09G 2320/045* (2013.01)

(58) Field of Classification Search
CPC ..... G09G 3/3208–3291
See application file for complete search history.

(56) References Cited

U.S. PATENT DOCUMENTS

| | | | | |
|---|---|---|---|---|
| 8,188,946 | B2 * | 5/2012 | Nathan | G09G 3/3233 345/77 |
| 9,412,305 | B2 * | 8/2016 | Lee | G09G 3/3266 |
| 9,564,083 | B2 | 2/2017 | Bae | |
| 9,947,269 | B2 * | 4/2018 | Jung | G09G 3/2085 |
| 2009/0225009 | A1 | 9/2009 | Ka | |
| 2012/0287025 | A1 * | 11/2012 | Inoue | G09G 3/3233 345/76 |

(Continued)

FOREIGN PATENT DOCUMENTS

| | | | |
|---|---|---|---|
| CN | 101527114 | A | 9/2009 |
| CN | 103489395 | A | 1/2014 |

(Continued)

OTHER PUBLICATIONS

European Extended Search Report, European Application No. 16191053.4, dated Jan. 4, 2017, 7 pages.

(Continued)

*Primary Examiner* — Patrick F Marinelli
(74) *Attorney, Agent, or Firm* — Fenwick & West LLP

(57) ABSTRACT

Disclosed is an Organic Light Emitting Diode (OLED) display including pixels and a shift register for driving transistors arranged in the pixels. The pixels include a first group of pixels disposed on a first row, and a second group of pixels disposed on a second row. The shift register applies a first scan signal to the first group of pixels and the second group of pixels simultaneously. In addition, the shift register applies a second scan signal to the first group of pixels and the second group of pixels sequentially.

14 Claims, 11 Drawing Sheets

(56) References Cited

U.S. PATENT DOCUMENTS

| | | | | |
|---|---|---|---|---|
| 2014/0198136 | A1* | 7/2014 | Lee | G09G 3/3266 345/690 |
| 2014/0333513 | A1* | 11/2014 | Park | G09G 3/3266 345/76 |
| 2014/0333682 | A1 | 11/2014 | Okuno et al. | |
| 2014/0362069 | A1 | 12/2014 | Liu et al. | |
| 2015/0061537 | A1* | 3/2015 | Kanda | G09G 3/00 315/291 |
| 2015/0170576 | A1 | 6/2015 | Bae | |
| 2016/0063921 | A1* | 3/2016 | Tsai | G09G 3/3233 345/76 |
| 2016/0217744 | A1* | 7/2016 | Song | G09G 3/3233 |
| 2016/0351121 | A1* | 12/2016 | Kim | G09G 3/3233 |
| 2016/0351122 | A1* | 12/2016 | Jung | G09G 3/2085 |
| 2017/0092199 | A1* | 3/2017 | Park | G09G 3/3258 |
| 2017/0092200 | A1* | 3/2017 | Park | G09G 3/3233 |
| 2018/0137816 | A1* | 5/2018 | Cheng | G09G 3/2092 |
| 2018/0182289 | A1* | 6/2018 | Jung | H01L 27/3276 |

FOREIGN PATENT DOCUMENTS

| | | | |
|---|---|---|---|
| CN | 103956140 | A | 7/2014 |
| CN | 104282266 | A | 1/2015 |
| KR | 20150070718 | A | 6/2015 |
| WO | WO 2016032545 | A1 | 3/2016 |

OTHER PUBLICATIONS

First Office Action, Chinese Patent Application No. 201610875930.0, dated Jul. 30, 2018, 18 pages.

* cited by examiner

ORGANIC LIGHT EMITTING DIODE (OLED) DISPLAY

CROSS-REFERENCE TO RELATED APPLICATION

This application claims the benefit of Republic of Korea Patent Application No. 10-2015-0138255 filed on Sep. 30, 2015, which is incorporated herein by reference for all purposes as if fully set forth herein.

BACKGROUND

Field of the Invention

The present disclosure relates to an active matrix Organic Light Emitting Diode (OLED) display.

Discussion of the Related Art

A Flat Panel Display (FPD) is widely used for a desktop monitor, a laptop, a Personal Distal Assistant (PDA), and any other mobile computer or mobile phone terminal, because the FPD can be implemented in a smaller form factor with reduced weight. The FPD includes a Liquid Crystal Display (LCD), a Plasma Display Panel (PDP), a Field Emission Display (FED), and an Organic Light Emitting Diode (OLED) display.

The OLED display has a fast response speed and a wide viewing angle, and is able to output an image with high luminous efficiency. An example structure of self-luminous OLED is shown in FIG. 1. An OLED includes, an anode electrode, a cathode electrode, and organic compound layers formed between the anode electrode and the cathode electrode. The organic compound layers include a Hole Injection Layer (HIL), a Hole Transport Layer (HTL), an Emission Layer (EML), an Electron Transport Layer (ETL), and an Electron Injection Layer (EIL). Once a driving voltage is applied to the anode electrode and the cathode electrode, a hole having passed the HTL and an electron having passed the ETL are moved to the EML to thereby form an exciton. As a result, the EML generates visible lights.

Generally, an OLED display uses a scan transistor, which is turned on by a scan signal, to apply a data voltage to a gate electrode of a driving transistor, and enables an OLED to emit light using the data voltage supplied to the driving transistor. In addition, the OLED display uses an emission control signal to perform switching of a transistor coupled to the driving transistor and a high-potential voltage input terminal.

Driving circuits generating a scan signal and an emission control signal may be formed in a Gate In Pale (GIP) method in a bezel area of a display panel. However, it is difficult to reduce the size of the bezel area because of a GIP circuit.

SUMMARY

An Organic Light Emitting Diode (OLED) display according to the present disclosure includes a plurality of pixels and a shift register which drives transistors arranged in the pixels. The plurality of pixels include a first group of pixels disposed on a first row, and a second group of pixels disposed on a second row. The shift register applies a first scan signal to the first group of pixels and the second group of pixels simultaneously. In addition, the shift register applies a second scan signal to the first group of pixels and the second group of pixels sequentially.

In one or more embodiments, each of the plurality of pixels comprises an OLED, a driving transistor including a gate electrode connected to a first node, a drain electrode connected to a second node, and a source electrode connected to a third node, the driving transistor configured to control a driving current supplied to the OLED, a first transistor connected between the first node and the second node, and a second transistor connected between the third node and a respective data line. The shift register comprises a first scan signal stage configured to, simultaneously, apply a first scan signal to first transistors of the first group of pixels and first transistors of the second group of pixels, and a second scan signal stage configured to apply a second scan signal to second transistors of the first group of pixels and subsequently apply the second scan signal to second transistors of the second group of pixels.

In one or more embodiments, the first scan signal causes the first transistors of the first group of pixels and the first transistors of the second group of pixels to be turned on simultaneously to cause driving transistors of the first group of pixels and driving transistors of the second group of pixels to be diode-connected.

In one or more embodiments, the second scan signal stage is configured to apply the second scan signal to the second transistors of the first group of pixels and subsequently apply the second scan signal to the second transistors of the second group of pixels, while the first scan signal stage applies the first scan signal to the first transistors of the first group of pixels and the first transistors of the second group of pixels.

In one or more embodiments, each of the plurality of pixels further comprises a capacitor coupled between the first node and a fourth node, the OLED coupled to the fourth node, the driving transistor to control the driving current according to charges stored in the capacitor, and a third transistor coupled between the fourth node and an initialization voltage input terminal, the initialization voltage input terminal to supply an initialization voltage. Third transistors of the first group of pixels and third transistors of the second group of pixels may be simultaneously turned on in response to the first scan signal to apply the initialization voltage to capacitors of the first group of pixels and capacitors of the second group of pixels.

In one or more embodiments, the first scan signal stage is configured to turn on the first transistors of the first group of pixels and the first transistors of the second group of pixels for a period, the period comprising a first sub-period, a second sub-period, and a third sub-period. During the first sub-period, the second scan signal stage may be configured to turn off the second transistors of the first group of pixels and the second transistors of the second group of pixels. During the second sub-period, the second scan signal stage may be configured to turn on the second transistors of the first group of pixels and to turn off the second transistors of the second group of pixels. During the third sub-period, the second scan signal stage may be configured to turn off the second transistors of the first group of pixels and to turn on the second transistors of the second group of pixels.

In one or more embodiments, the plurality of pixels further comprise a third group of pixels disposed on a third row adjacent to the first row, the first row disposed between the second row and the third row. During the first sub-period, the first scan signal stage may be configured to turn on first transistors of the third group of pixels, the first transistors of the first group of pixels, and the first transistors of the second group of pixels. During the second sub-period and the third sub-period, the first scan signal stage may be configured to turn on the first transistors of the first group of pixels, and the first transistors of the second group of pixels, and to turn off the first transistors of the third group of pixels.

In one or more embodiments, each of the plurality of pixels further comprises a fourth transistor coupled between the second node and a high-potential voltage input terminal, the high-potential voltage input terminal to supply a high-potential voltage; and a fifth transistor coupled between the third node and the OLED.

In one or more embodiments, the shift register further comprises an emission control signal stage configured to, during the first sub-period, turn off fourth transistors of the third group of pixels and turn off fifth transistors of the third group of pixels, turn on fourth transistors of the first group of pixels and turn off fifth transistors of the first group of pixels, and turn on fourth transistors of the second group of pixels and turn on fifth transistors of the second group of pixels.

In one or more embodiments, the emission control signal stage is further configured to, during the second sub-period, turn off the fourth transistors of the third group of pixels and turn on the fifth transistors of the third group of pixels, turn off the fourth transistors of the first group of pixels and turn off the fifth transistors of the first group of pixels, and turn on the fourth transistors of the second group of pixels and turn off the fifth transistors of the second group of pixels.

One or more embodiments relate to a method of displaying an image by the OLED display. The method comprises: simultaneously applying, by a first scan signal stage of the shift register, a first scan signal to first transistors of the first group of pixels and first transistors of the second group of pixels; and sequentially applying, by a second scan signal stage of the shift register, a second scan signal to second transistors of the first group of pixels and second transistors of the second group of pixels.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
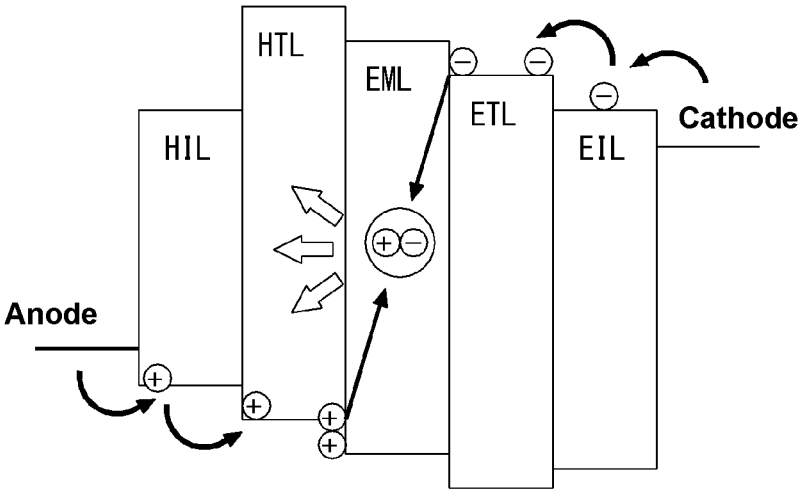
FIG. 1 is a diagram illustrating a principle of how an Organic Light Emitting Diode (OLED) emits light.

Hereinafter, the embodiments disclosed in the present specification will be described in detail with reference to the accompanying drawings, and the same or similar elements are denoted by the same reference numerals even though they are depicted in different drawings and redundant descriptions thereof will be omitted. In embodiments of the present disclosure, transistors of a pixel are all implemented as N-type transistors. However, aspects of the present disclosure are not limited thereto, and the transistors may be implemented as P-type transistors.

Figure 2:
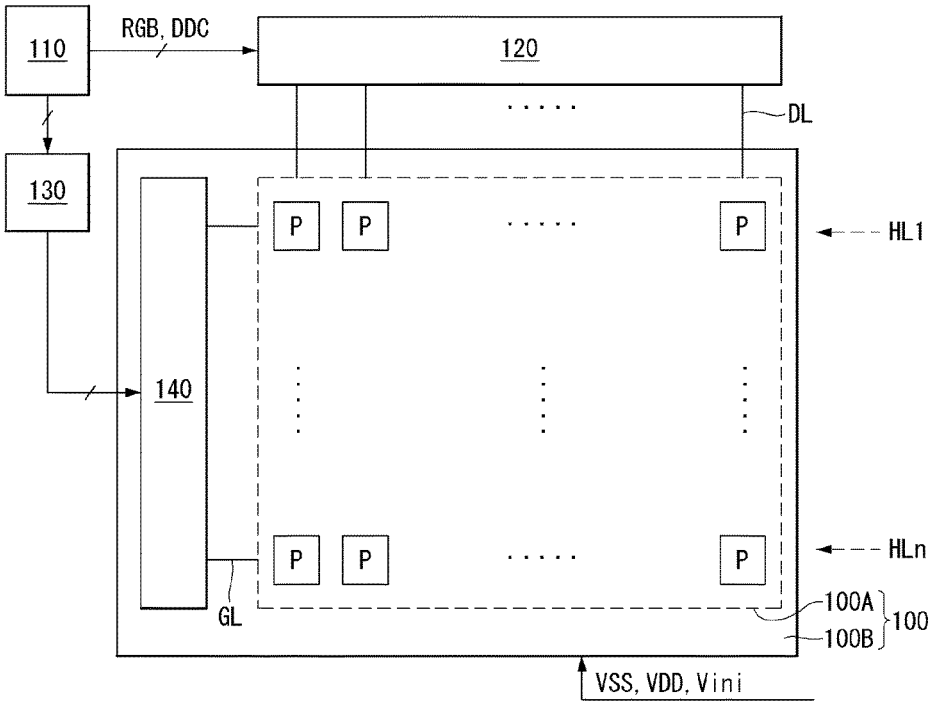
FIG. 2 is a diagram illustrating an OLED display according to an embodiment of the present disclosure.

FIG. 2 is a diagram illustrating an Organic Light Emitting Diode (OLED) display according to an embodiment of the present disclosure.

Referring to FIG. 2, the OLED display according an embodiment of the present disclosure includes a display panel 100 in which pixels P are arranged in matrix, a data driver 120, a gate driver comprising a level shifter 130 and a shift register 140, and a timing controller 110.

The display panel 100 includes a display portion 100A in which the pixels P are arranged to display an image, and a non-display portion 100B in which a shift register 140 is arranged and which does not display an image.

A plurality of pixels P are included in the display portion 100A, and an image is displayed based on gray scales displayed by the pixels P. The pixels P are arranged along the first horizontal line HL1 to a n-th horizontal line HLn.

Each of the pixels P is connected to a corresponding data line DL arranged along a column line, and to a corresponding gate line GL arranged along a horizontal line HL disposed in a row. As illustrated in FIG. 2, the gate line GL includes a first scan line SL1, a second scan line SL2, and an emission control signal line EML. In addition, each of the pixels P includes an OLED, a driving transistor DT, and first to fifth transistors T1 to T5, and a storage capacitor Cst. Each of the transistors DT and T1 to T5 may be implemented as an oxide Thin Film Transistor (TFT) including an oxide semiconductor layer. However, aspects of the present disclosure are not limited thereto, and the semiconductor layer of a transistor may be formed of an amorphous silicon semiconductor or an oxide semiconductor.

The timing controller 110 is configured to control operation timing of the data driver 120 and the gate driver comprising the level shifter 130 and the shift register 140. To this end, the timing controller 110 realigns digital video data RGB, which is received from the outside, to fit the resolution of the display panel 100, and supplies the realigned digital video data RGB to the data driver 120. In addition, the timing controller 110 generates a control signal DDC for controlling operation timing of the data driver 120, and a gate control signal GDC for controlling operation timing of the gate driver, based on timing signals, such as a vertical synchronizing signal Vsync, a horizontal synchronizing signal Hsync, a dot clock signal DCLK, and a data enable signal DE.

The data driver 120 is configured to drive data lines DL. To this end, based on the data control signal DDC, the data driver 120 converts digital video data RGB, which is received from the timing controller 110, into an analog data voltage, and supplies the analog data voltage to the data lines DL.

The gate driver includes a level shifter 130 and a shift register 140. The level shifter 130 is formed as an Integrated Circuit (IC) on a Printed Circuit Board (PCB) (now shown) connected to the display panel 100. The shift register 140 is formed on the non-display portion 100B of the display panel 100 by using a Gate In Panel (GIP) scheme.

The level shifter 130 performs level shifting of the clock signals CLK and a start signal VST under the control of the timing controller 110, and supplies the level-shifted clock signals CLK and the level-shifted start signal VST to the shift register 140. The shift register 140 is formed as a combination of multiple TFTs (hereinafter referred to simply as transistors) in the non-display portion 100B of the display panel 100 by using the GIP scheme. The shift register 140 is comprised of stages which shift scan signals and output the shifted scan signals in response to the clock signals CLK and the start signal VST.

Figure 3:
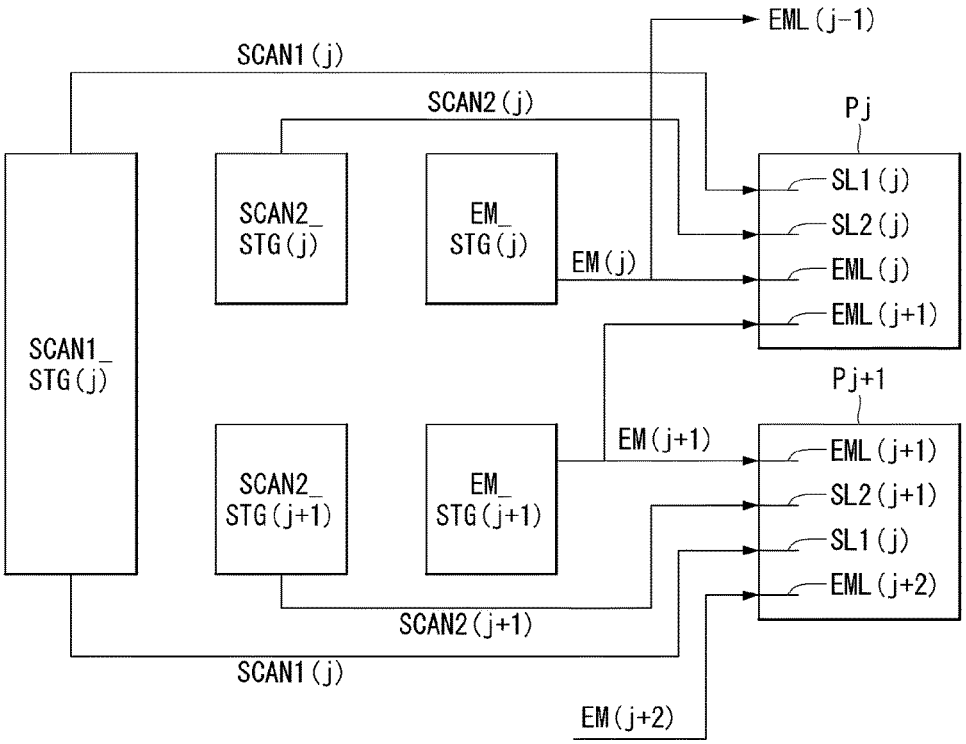
FIG. 3 is a diagram illustrating a shift register according to an embodiment of the present disclosure.
Figure 4:
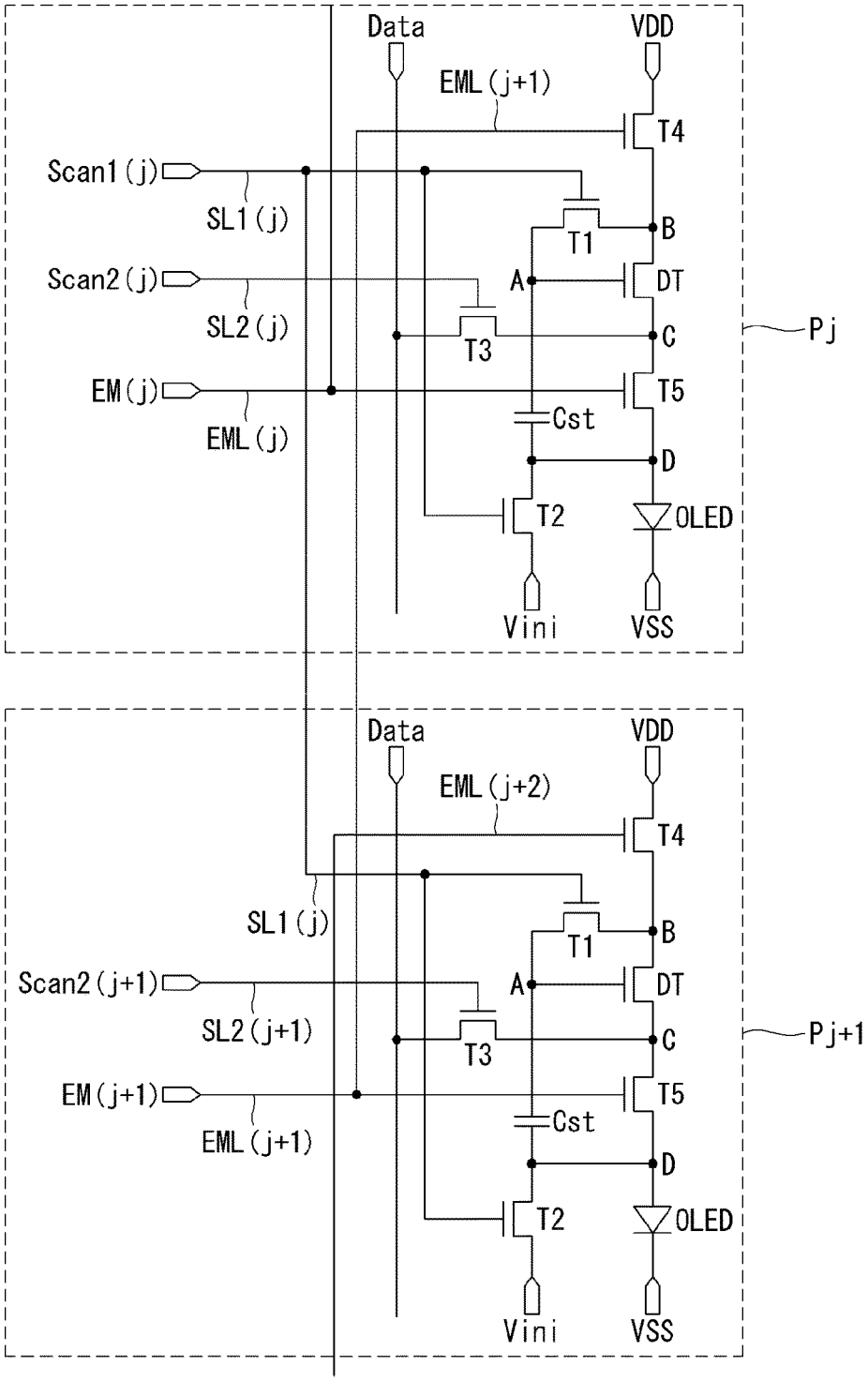
FIG. 4 is a diagram illustrating a structure of a pair of adjacent pixels.

Referring to FIG. 3, there is shown a stage of the shift register 140 for driving pixels Pj arranged along a j-th horizontal line and pixels Pj+1 arranged along a (j+1)-th horizontal line. As shown in FIG. 4, the pixels arranged along the j-th horizontal line include a j-th emission control signal line EML(j) and a (j+1)-th emission control signal line EML(j+1).

To drive the pixels arranged along the two adjacent horizontal lines HLj and HL(j+1), the shift register 140 includes a j-th first scan signal stage SCAN1_STG(j), a j-th second scan signal stage SCAN2_STG(j), a (j+1)-th second scan signal stage SCAN2_STG(j+1), a j-th emission control signal stage EM_STG(j), and a (j+1)-th emission control signal stage EM_STG(j+1).

The j-th first scan signal stage SCAN1_STG(j) generates a j-th first scan signal SCAN1(*j*), and applies the j-th first scan signal SCAN1(*j*) to a j-th first scan line SL1(*j*) arranged along a j-th horizontal line and to a (j+1)-th first scan line SL1(*j*+1) arranged along a (j+1)-th horizontal line.

The j-th second scan signal stage SCAN2_STG(j) generates a j-th second scan signal SCAN2(*j*), and applies the j-th second scan signal SCAN2(*j*) to a j-th second scan line SL2(*j*) arranged along the j-th horizontal line.

The (j+1)-th second scan signal stage SCAN2_STG(j+1) generates a (j+1)-th second scan signal SCAN(j+1), and applies the (j+1)-th second scan signal SCAN(j+1) to a (j+1)-th second scan line SL2(*j*+1) arranged along a (j+1)-th horizontal line.

The j-th emission control signal stage EM_STG(j) generates a j-th emission control EM(j), and applies the j-th emission control EM(j) to a j-th emission control signal line EML(j) arranged along the j-th horizontal line and to a (j−1)-th emission control signal line EML(j−1) arranged along a (j−1)-th horizontal line.

As such, a first scan signal is applied to the pixels Pj and Pj+1 arranged along a pair of two adjacent horizontal lines, so it is possible to drive pixels arranged along n number of horizontal lines using n/2 number of the first scan signal stages. That is, it is possible to reduce the entire area of the shift register 140 and thus reduce a bezel area of the non-display portion 100B.

FIG. 3 is a waveform diagram showing a pixel structure according to an embodiment of the present disclosure. FIG. 4 is a waveform diagram showing a data signal and a gate signal applied to a pixel shown in FIG. 3.

Referring to FIG. 3, each pixel PXL arranged on a j-th pixel line (j indicates a natural number) includes an OLED, a driving transistor DT, first to fifth transistors T1 to T5, and a storage capacitor Cst.

The OLED emits light by a driving current supplied from the driving transistor DT. As shown in FIG. 1, multiple organic compound layers are formed between an anode electrode and a cathode electrode of the OLED. The organic compound layers include Hole Injection Layers (HIL), Hole Transport Layers (HTL), Emission Layers (EML), Electron Transport Layers (ETL), and Electron Injection Layers (EIL). The anode electrode of the OLED is connected to a node D, and a cathode electrode of the OLED is connected to an input terminal of low-potential driving voltage ELVSS.

The driving transistor DT uses its gate-source voltage Vgs to control a driving current applied to the OLED. The driving transistor DT includes a gate electrode connected to a node A, a drain electrode connected to a node B, and a source electrode connected to a node C.

The first transistor T1 is connected between the node A and the node B, and turned on/off in accordance with a first scan signal SCAN1. The first transistor T1 includes a gate electrode connected to the j-th first scan line SL1(*j*) to which the first scan signal SCAN1 is applied, a drain electrode connected to the node B, and a source electrode connected to the node A.

The second transistor T2 is connected between the node D and an input terminal of an initialization voltage Vinit, and turned on/off in accordance with a j-th first scan signal SCAN1(*j*). The second transistor T2 includes a gate electrode connected to the j-th first scan line SL(j) to which the j-th first scan signal SCAN1(*j*) is applied, a drain electrode connected to the node D, and a source electrode connected to the input terminal of the initialization voltage Vinit.

The third transistor T3 is connected between a data line DL and the node C, and turned on/off in accordance with a j-th second scan signal SCAN2(*j*). The third transistor T3 includes a gate electrode connected to the j-th second scan line SL2(*j*) to which the second scan signal SCAN2(*j*) is applied, a drain electrode connected to the data line DL, and a source electrode connected to the node C.

The fourth transistor T4 is connected between an input terminal of the high-potential voltage VDD and the node B, and turned on/off in accordance with a (j+1)-th emission control signal EM(j+1). The fourth transistor T4 includes a gate electrode connected to a (j+1)-th emission control signal line EML(j+1) to which a (j+1)-th emission control signal EM(j+1) is applied, a drain electrode connected to the input terminal of the high-potential voltage VDD, and a source electrode connected to the node B.

The fifth transistor T5 is connected between the node D and the node C, and turned on/off in accordance with a j-th emission control signal EM(j). The fifth transistor T5 includes a gate electrode connected to the j-th emission control signal line EML(j) to which the j-th emission control signal EM(j) is applied, a drain electrode connected to the node C, and a source electrode connected to the node D.

The storage capacitor Cst is connected between the node A and the node D.

Figure 5:
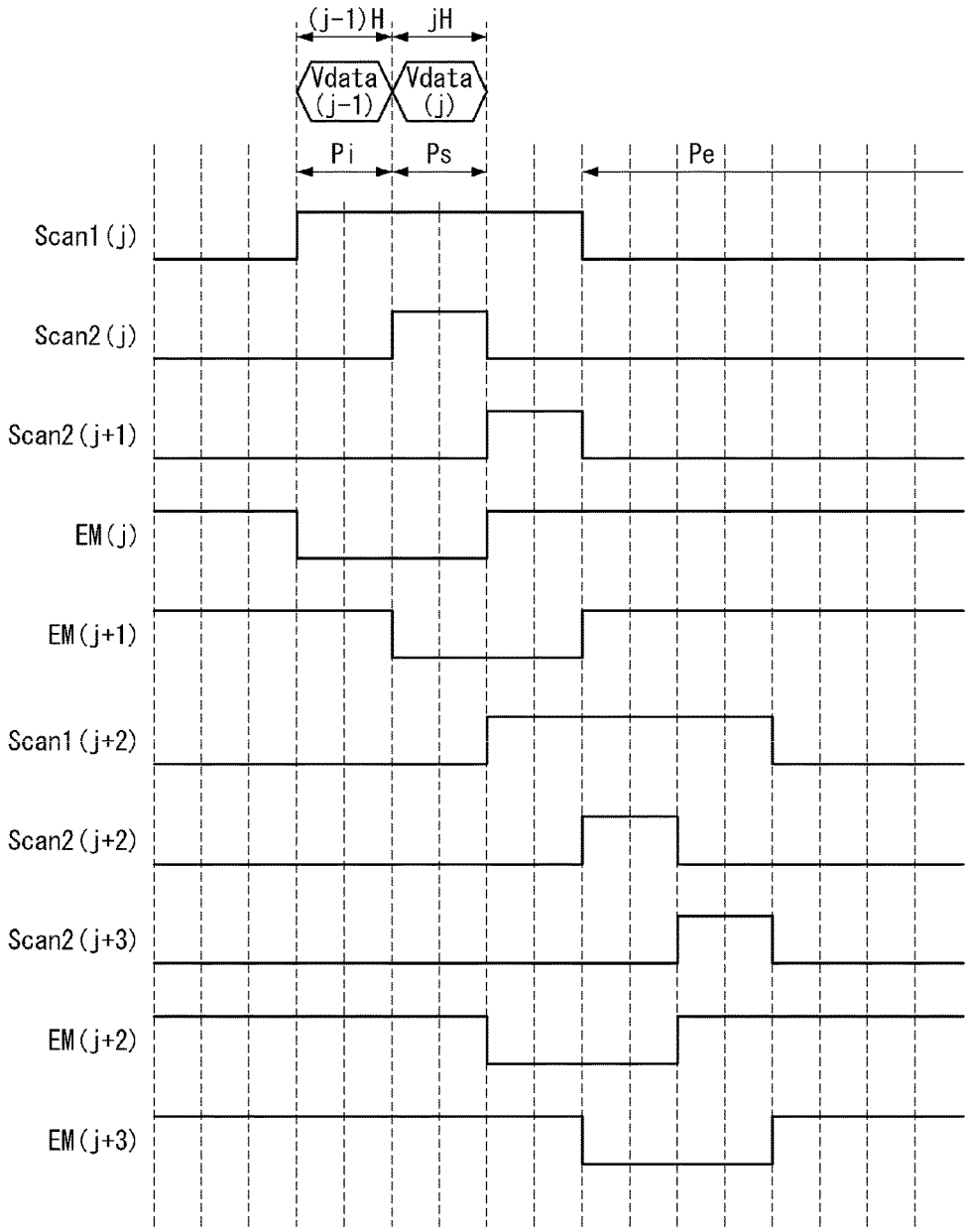
FIG. 5 is a diagram illustrating a data signal and a gate signal applied to pixels shown in FIG. 4.

Followings are descriptions about an operation of a pixel P in the above-described structure. FIG. 5 is a waveform diagram showing signals EM, SCAN, and DATA applied to the pixel shown in FIG. 4. In the drawings, a j-th horizontal period jH indicates a scanning period of pixels P arranged along a j-th horizontal line HLj.

Figure 6A:
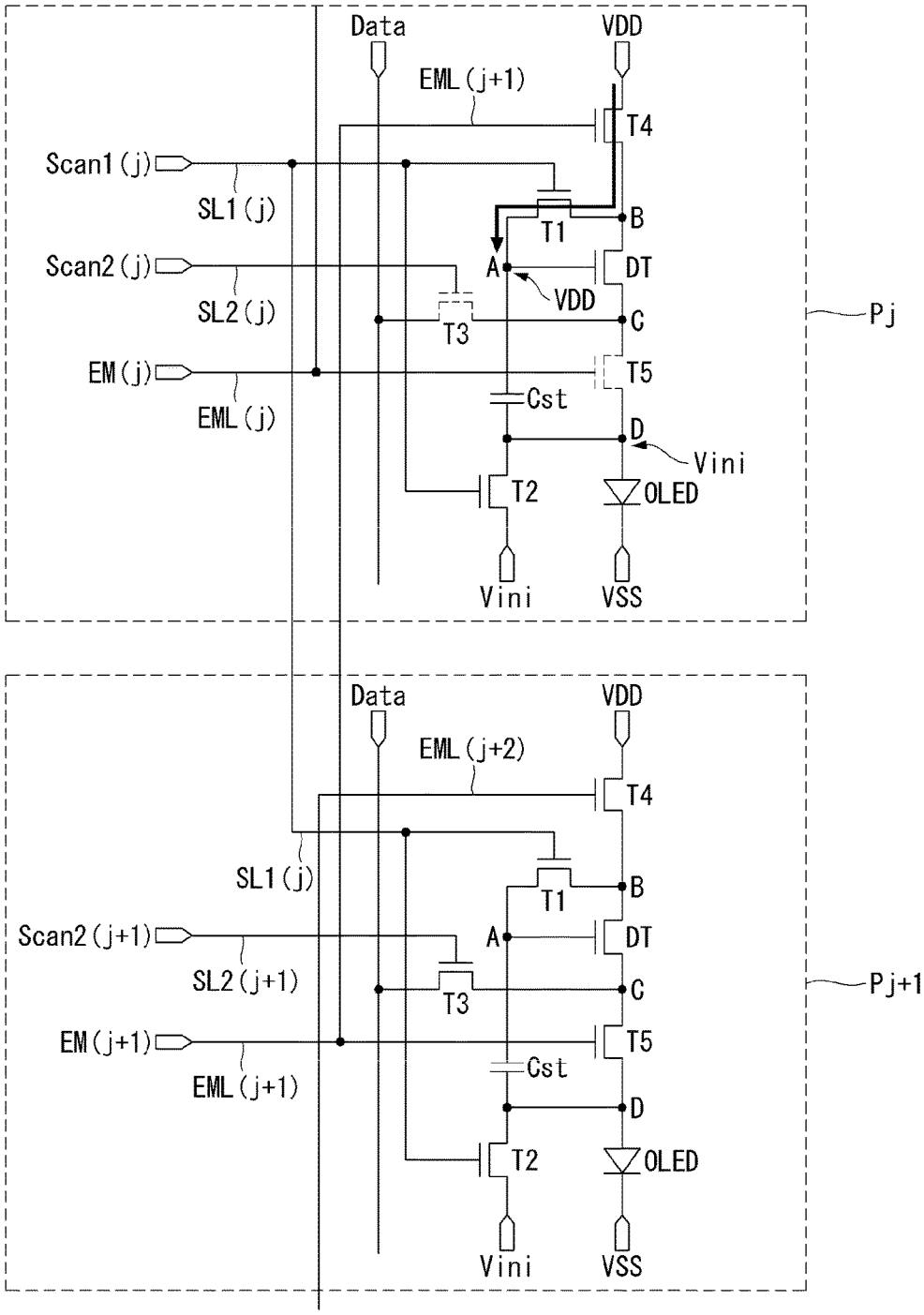
FIGS. 6A, 6B, and 6C are equivalent circuits of a pixel according to an embodiment of the present disclosure.
Figure 6B:
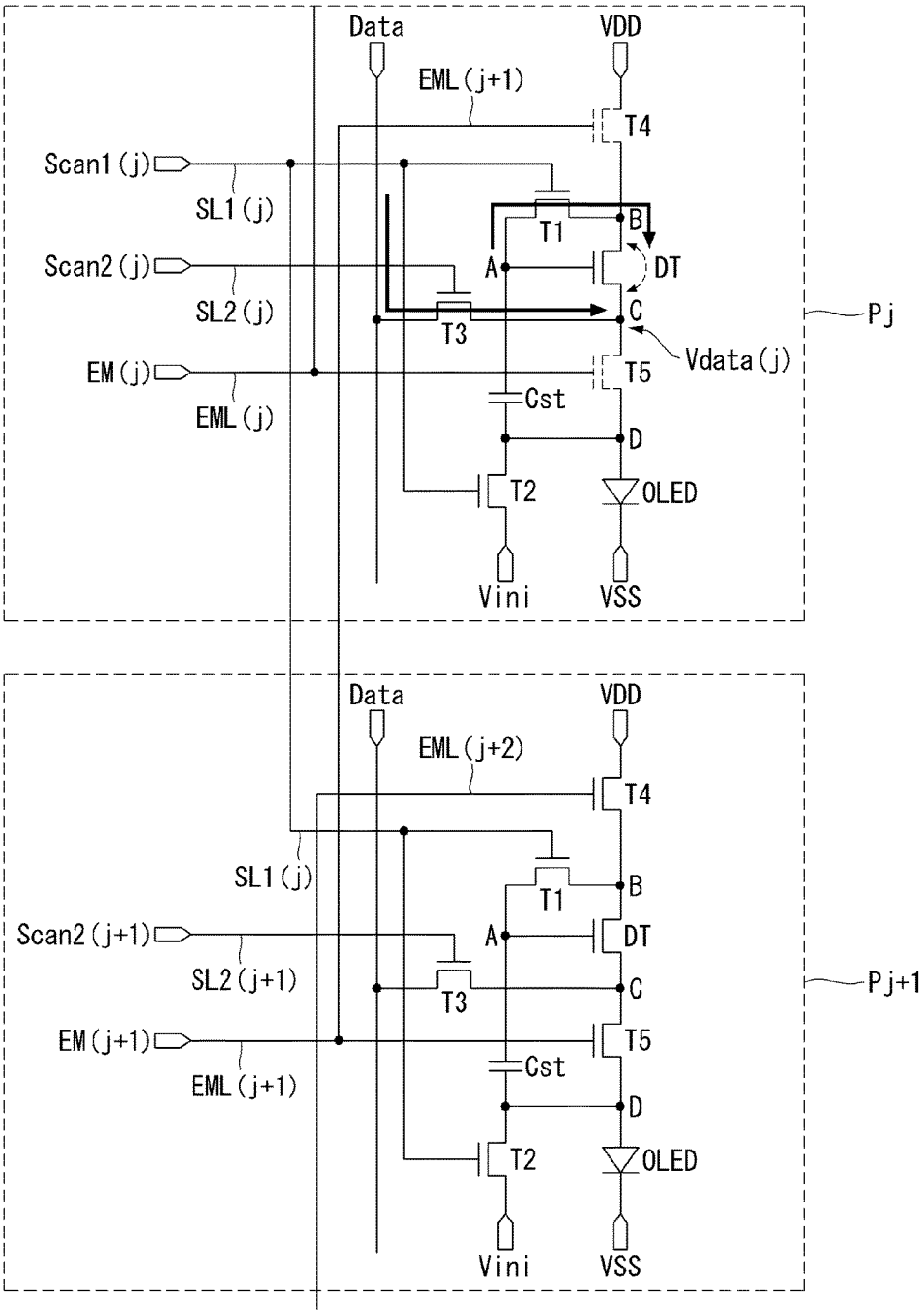
Figure 6C:
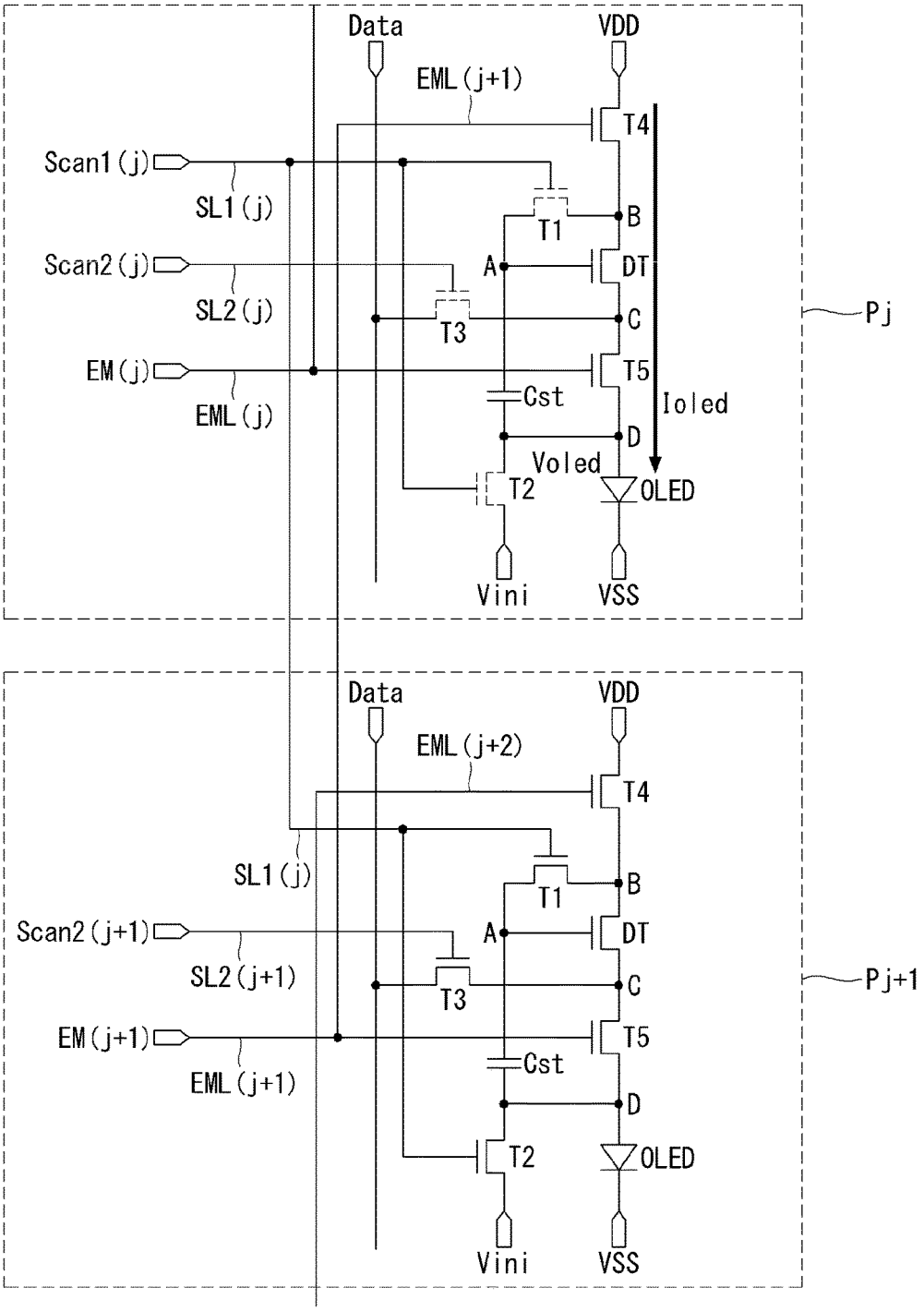

FIGS. 6A to 6C are equivalent circuits of a pixel P in an initialization period Pi, a sampling period Ps, and an emission period Pe. In FIGS. 6A to 6C, a solid line indicates an activated element or a connected current path, and a dotted line indicates an inactivated element or a disconnected current path.

As shown in FIG. 5, one frame period may be divided into: the initialization period Pi for initializing the node A and the node D; the sampling period Ps for sampling a threshold voltage of the driving transistor DT and storing the sampled threshold voltage in the node A; and the emission period Pe for programming a gate-source voltage of the driving transistor DT based on the sampled threshold voltage, and driving the OLED to emit light by a driving current according to the programmed gate-source voltage.

The present disclosure initializes pixels arranged along the j-th horizontal line HLj in a (j−1)-th horizontal period (j−1)H, so that a j-th horizontal period jH may be spent only for sampling operation. If the sampling period Ps is secured long enough, it is possible to more accurately sample a threshold voltage of the driving transistor DT.

Followings are descriptions about an operation of pixels arranged along the j-th horizontal line HLj.

During the initialization period Pi, a j-th first scan signal SCAN1(*j*) and a (j+1)-th emission control signal EM(j+1) are applied at on level, and a j-th second scan signal SCAN2(*j*) and a j-th emission control signal EM(j) are applied at off level. In the initialization period Pi, the first and second transistors T1 and T2 are turned on in response to the j-th first scan signal SCAN1(*j*), and the fourth transistor T4 is turned on in response to the (j+1)-th emission control signal EM(j+1). Accordingly, the node A is initialized to the high-potential voltage VDD, and the node D is initialized to the initialization voltage Vinit. The reason that the nodes A and D are initialized before sampling operation is to prevent unnecessary emission of the OLED. To this end, the initialization voltage Vinit is selected from a voltage range sufficiently lower than a driving voltage of the OLED. That is, the initialization voltage Vinit may be set to be equal to or lower than the low-potential voltage VSS.

During the sampling period Ps, the j-th first scan signal SCAN1(*j*) and the j-th second scan signal SCAN1(*j*) are applied with on level, and the j-th emission control signal EM(j) and the (j+1)-th emission control signal EM(j+1) are applied with off level. In the sampling period Ps, the first and second transistors T1 and T2 are turned on in response to the j-th first scan signal SCAN1(*j*), and the third transistor T3 is turned on in response to the j-th second scan signal SCAN2(*j*). Accordingly, the driving transistor DT is diode-connected (which means that a gate electrode and a drain electrode of the driving transistor DT are short-circuited, so the driving transistor DT acts as a diode), and a data voltage Vdata(j) is applied to the node C. Here, a sufficiently low voltage such that Vdata(j)<VDD-Vth is applied, thus the driving transistor DT may be turned on in the sampling period Ps. In the sampling period Ps, a current Ids flows between the drain electrode and the source electrode of the driving transistor DT, and the potential of the node A is reduced by the current Ids to Vdata(j)+Vth which is the sum of the data voltage Vdata(j) and a threshold voltage Vth of the driving transistor DT.

The j-th first scan signal SCAN1(*j*) and the j-th second scan signal SCAN2(*j*) are applied at off level in the emission period Pe, and the j-th emission control signal EM(j) and the (j+1)-th emission control signal EM(j+1) are applied at on level after one horizontal period 1H has elapsed from the beginning in time of the emission period Pe.

In the emission period Pe, the fourth transistor T4 is turned on in response to the (j+1)-th emission control signal EM(j+1), thereby connecting the high-potential voltage VDD to the drain electrode of the driving transistor DT. In addition, in the emission period Pe, the fifth transistor T5 is turned on in response to the j-th emission control signal EM(j), thereby causing the potential of the nodes C and D to be equal to an operation voltage Voled of the OLED.

In the emission period Pe, the potential of the node D is changed from the initialization voltage Vinit to the operation voltage Voled of the OLED. In the emission period Pe, the node A is floating and coupled to the node D through the storage capacitor Cst. As a result, the potential of the node A is also changed from the voltage Vdata(j)+Vth set in the sampling period Ps according to the variation in the potential of the node D Voled−Vinit. That is, the potential of the node C and node D are set to "Voled", and accordingly the gate-source voltage Vgs, which is the gate voltage Vg of the driving transistor DT subtracted by the source voltage Vs thereof, is programmed to be "Vdata(j)+Vth-Vinit."

The function regarding a driving current Ioled flowing in the OLED in the emission period Pe is expressed as in Equation 1 as below. The OLED emits light according to the driving current, thereby producing a desired gray scale.

$$Ioled = \frac{k}{2}[(Vgs - Vth)]^2 = \frac{k}{2}[Vdata(n) - Vinit]^2 \quad \text{[Equation 1]}$$

In Equation 1, k denotes a proportional factor that is determined by electron mobility of the driving transistor DT, parasitic capacitance, and a channel capacity.

The expression of the driving current Ioled is $k/2(Vgs-Vth)^2$, but the gate-source voltage Vgs programmed in the emission period Pe already includes a threshold voltage component Vth of the driving transistor DT. Thus, as shown in Equation 1, the threshold voltage component Vth of the transistor DT is removed from the expression of the driving current Ioled. Accordingly, any variation in the threshold voltage Vth may not affect the driving current Ioled.

Meanwhile, another factor deteriorating luminance uniformity of an OLED display is deviation of high-potential voltage VDD applied to each pixel. However, the present disclosure does not include a high potential voltage component VDD in the expression of the driving voltage Ioled, so that any influence of the deviation of the high-potential voltage VDD does not affect the driving current Ioled.

Figure 7:
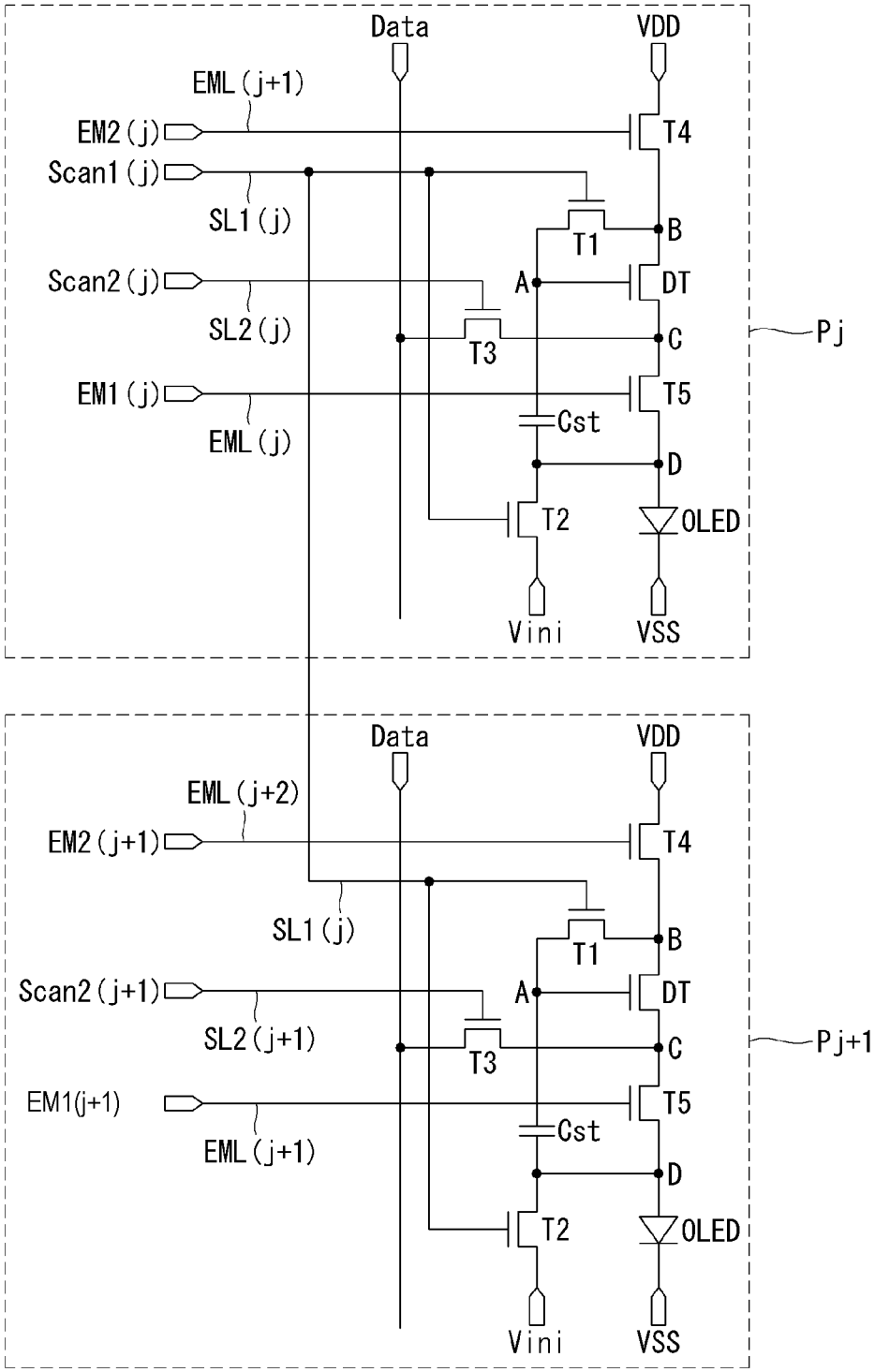
FIG. 7 is a diagram illustrating a pixel structure according to another embodiment of the present disclosure.
Figure 8:
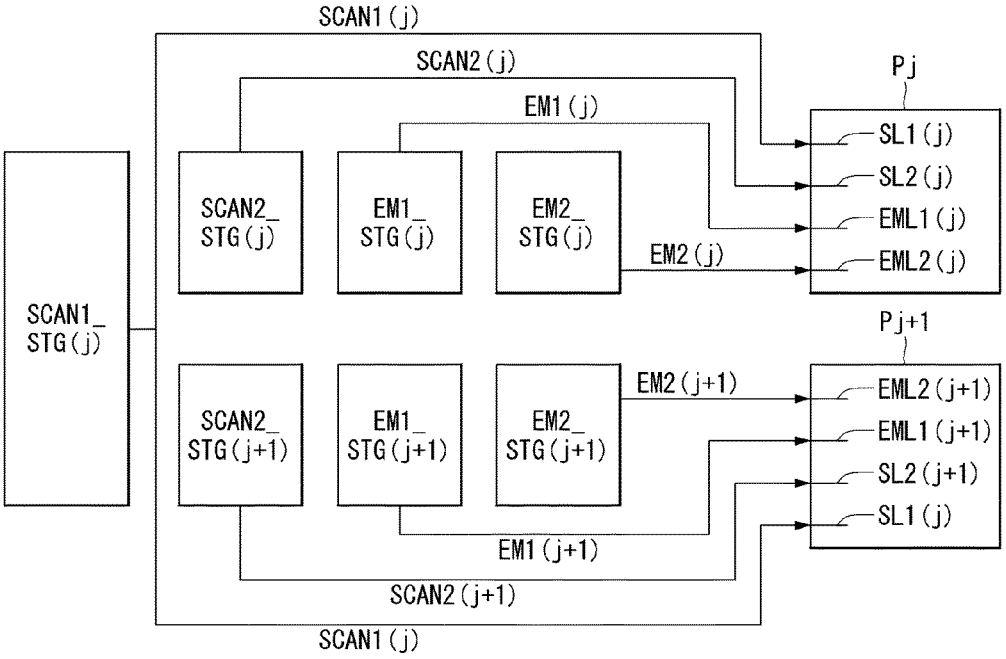
FIG. 8 is a diagram illustrating a shift register according to another embodiment of the present disclosure.

FIG. 7 is a diagram illustrating a pixel structure according to another embodiment of the present disclosure, and FIG. 8 is a diagram illustrating a shift register for driving a pixel P shown in FIG. 7.

In the above embodiments, the fourth transistor T4 receives an emission control signal generated by a rear-end stage. That is, a (j+1)-th emission control signal EM1(*j*+1) is applied to the fourth transistors of pixels arranged along a j-th horizontal line, and to the fifth transistors of pixels arranged along a (j+1)-th horizontal line. One horizontal period immediately after the end of a sampling period of the j-th horizontal line corresponds to a sampling period of the (j+1)-th horizontal line. In the sampling period of the (j+1)-th horizontal line, a fifth transistor T5 has to be maintained turned-off, so an emission period of the j-th horizontal line starts one horizontal period after the sampling period ends. In the pixel structure shown in FIG. 7, an emission control signal is applied to each individual pixel arranged along each horizontal line, and thus, an emission period starts immediately after a sampling period ends.

Referring to FIGS. 7 and 8, a pixel structure according to another embodiment of the present disclosure, and a shift register for driving the pixel are described in the following. In FIGS. 7 and 8, constituent elements, components or structures substantially identical to those shown in the aforementioned examples are indicated by the same reference numerals, and detailed descriptions thereof are herein omitted.

In FIG. 7, the fourths transistors T4 of pixels Pj arranged along a j-th horizontal line are turned on or off by a j-th second emission control signal EM2(*j*). The fifth transistors T5 of the pixels Pj arranged along the j-th horizontal line are turned on or off by a j-th first emission control signal EM1(*j*). Referring to FIG. 8, the j-th first emission control signal EM1(*j*) is generated by a j-th first emission control stage EM1 STG(j), and the j-th second emission control signal EM2(*j*) is generated by a j-th second emission control signal stage EM2 STG(j).

Figure 9:
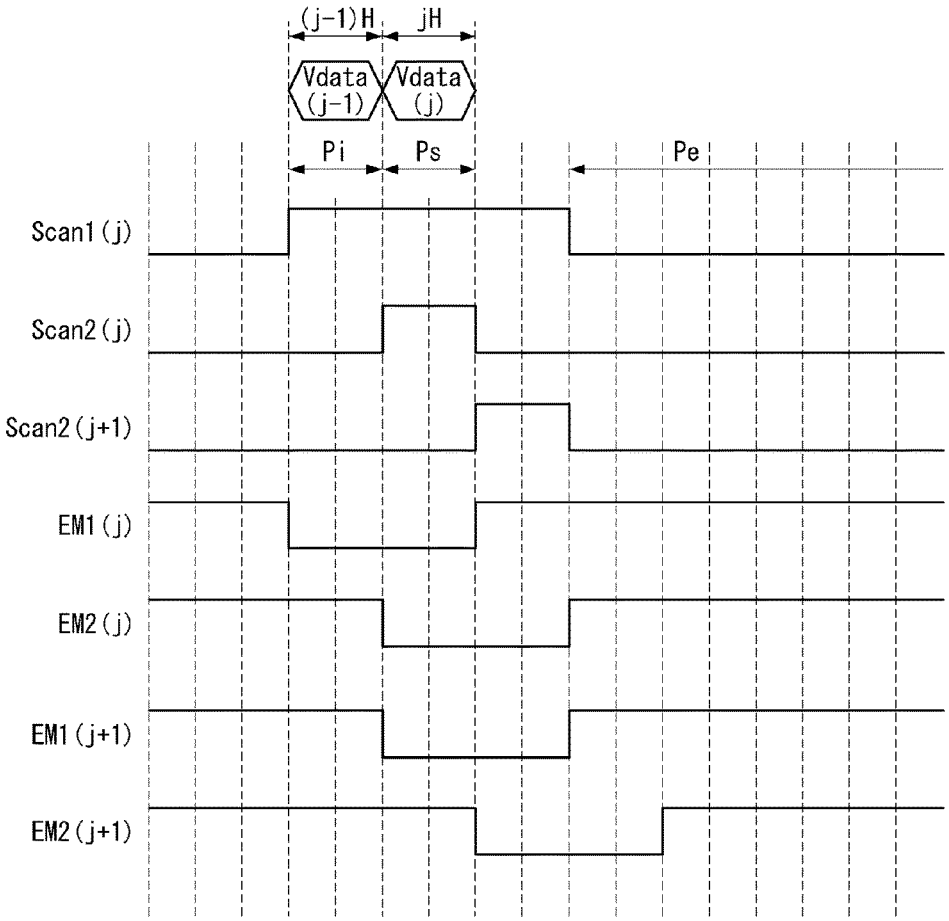
FIG. 9 is a diagram illustrating a data signal and a gate signal applied to pixels shown in FIG. 7.

FIG. 9 is a diagram illustrating timing of signals EM, SCAN, and DATA applied to a pixel P shown in FIG. 7. A method for driving the pixel P shown in FIG. 7 using the signals shown in FIG. 9 is substantially identical to the describe above with respect to FIGS. 3 through 6.

That is, in the initialization period Pi of pixels Pj arranged along a j-th horizontal line, a first scan signal SCAN1(*j*) is used to turn on the first and second transistors T1 and T2, thereby initializing the node A and the node D.

In the sampling period Ps, the first scan signal SCAN1(*j*) and a j-th second scan signal SCAN2(*j*) are used to cause the driving transistor DT to be diode-connected.

In the emission period Pe, a j-th first emission control signal EM1(*j*) and a j-th second emission control signal EM2(*j*) are used to set the nodes C and D to a driving voltage of the OLED and then supply a current to the OLED.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An Organic Light Emitting Diode (OLED) display comprising:

a plurality of pixels, arranged in rows and columns, comprising a first group of pixels disposed on a first row and a second group of pixels disposed on a second row; and a shift register configured to drive transistors arranged in the plurality of pixels, wherein each of the plurality of pixels comprises:

an OLED;

a driving transistor including a gate electrode connected to a node A, a drain electrode connected to a node B, and a source electrode connected to a node C, and configured to control a driving current supplied to the OLED connected to a node D;

a first transistor connected between the node A and the node B and including a gate electrode which receives a first scan signal;

a second transistor connected between the node D and an initialization voltage input terminal and including a gate electrode which receives the first scan signal, the initialization voltage input terminal having an initialization voltage;

a third transistor connected between a data line and the node C and including a gate electrode which receives a second scan signal;

a fourth transistor connected between the node B and a high-potential voltage input terminal, and comprising of a gate electrode connected to an emission control signal line for a next subsequent row of pixels; and a fifth transistor connected between the node C and the node D, and comprising of a gate electrode connected to an emission control signal line for the row that the pixel is disposed in, and wherein the shift register comprises:

a first scan signal stage configured to, simultaneously, apply the first scan signal to first transistors and second transistors of the first group of pixels and first transistors and second transistors of the second group of pixels;

second scan signal stages configured to apply the second scan signal to third transistors of the first group of pixels and subsequently apply the second scan signal to third transistors of the second group of pixels;

a first row emission control signal stage configured to apply an emission control signal to fifth transistors of the first group of pixels;

a second row emission control signal stage configured to apply an emission control signal to fourth transistors of the first group of pixels and to fifth transistors of the second group of pixels; and wherein the fourth transistors of the second group of pixels receive an emission control signal supplied to a third group of pixels disposed in the next row.

2. The OLED display of claim 1, wherein during an initialization period, the first transistor initializes the node A and the node B to a high-potential voltage and the second transistor initializes the node D to the initialization voltage in response to the first scan signal.

3. The OLED display of claim 2, wherein, during a sampling period subsequently following the initialization period, the first transistor is turned on in response to the first scan signal to configure the driving transistor to be diode-connected, and the third transistor is turned on in response to the second scan signal to apply a data voltage to the source electrode of the driving transistor.

4. The OLED display of claim 1, wherein the first row and the second row are adjacent to each other, and wherein the second scan signal stages comprises:

a first row second scan signal stage configured to apply the second scan signal to the third transistors of the first group of pixels, and a second row second scan signal stage configured to apply the second scan signal to the third transistors of the second group of pixels after the second scan signal being applied to the third transistors of the first group of pixels.

5. The OLED display of claim 4, wherein, during a sampling period of the first group of pixels, the first row second scan signal stage applies the second scan signal to the third transistors of the first group of pixels.

6. The OLED display of claim 1, wherein, during an initialization period and a sampling period of the first group of pixels, the first row emission control signal stage applies the emission control signal to the fifth transistors of the first group of pixels for turning off the fifth transistors of the first group of pixels.

7. The OLED display of claim 1, wherein, during an initialization period and a sampling period of the first group of pixels and during an initialization period and a sampling period of the second group of pixels, the first scan signal stage applies the first scan signal to (i) the first transistors and the second transistors of the first group of pixels and (ii) the first transistors and the second transistors of the second group of pixels simultaneously.

8. An Organic Light Emitting Diode (OLED) display comprising:

a plurality of pixels arranged in rows and columns, including a first group of pixels disposed on a first row, a second group of pixels disposed on a second row, and a third group of pixels disposed on a third row adjacent to the first row, the first row disposed between the second row and the third row, each of the plurality of pixels comprising:

an OLED, a driving transistor including a gate electrode connected to a first node, a drain electrode connected to a second node, and a source electrode connected to a third node, the driving transistor configured to control a driving current supplied to the OLED, a first transistor connected between the first node and the second node, and a second transistor connected between the third node and a respective data line;

a capacitor coupled between the first node and a fourth node, the OLED coupled to the fourth node, the driving transistor to control the driving current according to charges stored in the capacitor;

a third transistor coupled between the fourth node and an initialization voltage input terminal, the initialization voltage input terminal to supply an initialization voltage;

a fourth transistor coupled between the second node and a high-potential voltage input terminal, the high-potential voltage input terminal to supply a high-potential voltage, and comprising of a gate electrode connected to an emission control signal line for a next subsequent row of pixels; and a fifth transistor coupled between the third node and the OLED, and comprising a gate electrode connected to an emission control signal line for the row that the pixel is disposed in;

a shift register comprising:

a first scan signal stage configured to, simultaneously, apply a first scan signal to first transistors of the first group of pixels and first transistors of the second group of pixels;

second scan signal stages configured to apply a second scan signal to second transistors of the first group of pixels and subsequently apply the second scan signal to second transistors of the second group of pixels; and an emission control signal stage;

wherein the first scan signal stage is configured to turn on the first transistors of the first group of pixels and the first transistors of the second group of pixels for a period, the period comprising a first sub-period, a second sub-period, and a third sub-period; and wherein the shift register is configured to, during the first sub-period:

turn off fourth transistors of the third group of pixels and turn off fifth transistors of the first group of pixels, turn on fourth transistors of the first group of pixels and turn on fifth transistors of the second group of pixels, and turn on fourth transistors of the second group of pixels.

9. The OLED display of claim 8, wherein the first scan signal causes the first transistors of the first group of pixels and the first transistors of the second group of pixels to be turned on simultaneously to cause driving transistors of the first group of pixels and driving transistors of the second group of pixels to be diode-connected.

10. The OLED display of claim 8, wherein the second scan signal stages are configured to apply the second scan signal to the second transistors of the first group of pixels and subsequently apply the second scan signal to the second transistors of the second group of pixels, while the first scan signal stage applies the first scan signal to the first transistors of the first group of pixels and the first transistors of the second group of pixels.

11. The OLED display of claim 8, wherein third transistors of the first group of pixels and third transistors of the second group of pixels are simultaneously turned on in response to the first scan signal to apply the initialization voltage to capacitors of the first group of pixels and capacitors of the second group of pixels.

12. The OLED display of claim 8, wherein, during the first sub-period, the second scan signal stages are configured to turn off the second transistors of the first group of pixels and the second transistors of the second group of pixels, wherein, during the second sub-period, the second scan signal stages are configured to turn on the second transistors of the first group of pixels and to turn off the second transistors of the second group of pixels, and wherein, during the third sub-period, the second scan signal stages are configured to turn off the second transistors of the first group of pixels and to turn on the second transistors of the second group of pixels.

13. The OLED display of claim 8, wherein the shift register is further configured to, during the second sub-period, turn off the fourth transistors of the third group of pixels and turn off the fifth transistors of the first group of pixels, turn off the fourth transistors of the first group of pixels and turn off the fifth transistors of the second group of pixels, and turn on the fourth transistors of the second group of pixels.

14. A method of displaying an image by an organic light emitting diode (OLED) display, the OLED display comprising of a plurality of pixels and a shift register, the plurality of pixels are arranged in rows and columns including a first group of pixels disposed in a first row and a second group of pixels disposed on a second row, each of the plurality of pixels including an OLED, and a driving transistor including a gate electrode connected to a first node, a drain electrode connected to a second node, and a source electrode connected to a third node, the driving transistor configured to control a driving current supplied to the OLED, a first transistor connected between the first node and the second node, a second transistor connected between a fourth node and an initialization voltage terminal, a third transistor connected between the third node and a respective data line, a fourth transistor connected between the second node and a high-potential voltage input terminal and comprising of a gate electrode connected to an emission control signal line for the next subsequent row, and a fifth transistor connected between the third node and the fourth node and comprising of a gate electrode connected to an emission control signal line for the row that the pixel is disposed in, the method comprising:

simultaneously applying, by a first scan signal stage of the shift register, a first scan signal to first transistors of the first group of pixels and first transistors of the second group of pixels;

sequentially applying, by second scan signal stages of the shift register, a second scan signal to third transistors of the first group of pixels and third transistors of the second group of pixels;

applying, by a first row emission control signal stage of the shift register, an emission control signal to fifth transistors of the first group of pixels; and applying, by a second row emission control signal stage of the shift register, an emission control signal to fourth transistors of the first group of pixels and to fifth transistors of the second group of pixels;

wherein the fourth transistors of the second group of pixels receive an emission control signal supplied to a third group of pixels disposed in the next row.

* * * * *